US005826526A

United States Patent [19]

Tomita

[11] Patent Number: 5,826,526

[45] Date of Patent: Oct. 27, 1998

[54] SEWING MACHINE

[75] Inventor: Shintaro Tomita, Nagoya, Japan

[73] Assignee: Brother Kogyo Kabushiki Kaisha, Nagoya, Japan

[21] Appl. No.: 972,743

[22] Filed: Nov. 18, 1997

[30] Foreign Application Priority Data

Nov. 19, 1996 [JP] Japan ..... 8-308511

[51] Int. Cl.[6] ..... D05C 5/02; D05B 11/00; D05B 21/00

[52] U.S. Cl. ..... 112/102.5; 112/119; 112/458; 112/319; 364/470.09

[58] Field of Search ..... 112/102.54, 470.06, 112/117, 118, 119, 458, 445, 456, 323, 319, 314; 364/470.09

[56] References Cited

U.S. PATENT DOCUMENTS 4,368,683 1/1983 Takenoya ..... 112/314
4,554,879 11/1985 Eguchi ..... 112/445
4,558,142 12/1985 Peck ..... 112/454 X

FOREIGN PATENT DOCUMENTS 4-371189 12/1992 Japan .

*Primary Examiner*—Peter Nerbun
*Attorney, Agent, or Firm*—Oliff & Berridge, PLC

[57] ABSTRACT

A sewing machine includes a feed dog disposed in a bed of a main body to be displaced between positions above and below a top face of the bed in a normal state to feed a workpiece cloth, and a control device. When a presser foot is vertically moved during sewing, the control device judges that the feed dog is in the drop feed state. The vertical movement of the presser foot is detected on the basis of an output of a cloth thickness sensor which detects the height of the presser foot. When the feed dog is in the drop feed state, the control device judges whether a stitch pattern selected by a user is suitable for formation of stitches in the drop feed state of the feed dog. When the stitch pattern is unsuitable, information to that effect is provided, and the sewing is stopped.

14 Claims, 9 Drawing Sheets

SEWING MACHINE

BACKGROUND OF THE INVENTION

1. Field of the Invention

This invention relates to a sewing machine switchable between a normal state in which a feed dog is displaced between positions above and below a top face of a machine bed to feed a workpiece cloth and a drop feed state in which the feed dog remains at the position below the top face of the bed.

2. Description of the Prior Art

There have conventionally been provided household sewing machines wherein a user can select a desired one of a number of stitch patterns. These stitch patterns include a normal sewing such as straight stitch and zigzag stitch, character patterns, picture patterns, etc. Upon selection of a stitch pattern, the sewing machine performs a sewing operation based on the selected stitch pattern, thereby forming stitches according to the selected stitch pattern on a workpiece cloth.

The above-described sewing machines are designed to be switchable between a normal state in which a feed dog is displaced between positions above and below a top face of a machine bed to feed a workpiece cloth and a drop feed state in which the feed dog remains at the position below the top face of the bed. In the case where stitches are formed on the workpiece cloth, the workpiece cloth is fed by the feed dog when it is in the normal state, whereas the workpiece cloth is moved by the user when the feed dog is in the drop feed state.

In a field of quilting, for example, stitches have recently been formed on the workpiece cloth so as to resemble a picture in addition to merely joining two pieces of cloth. In such a sewing manner, it is desirable to freely vary a feed direction and amount of feed of the workpiece cloth per stitch. For this purpose, the feed dog is maintained in the drop feed state so that the sewing is performed with the workpiece cloth being moved by the user. This sewing manner is referred to as "free motion sewing."

In the free motion sewing, stitches can be formed on the workpiece cloth without deformation in the contour when the stitch pattern is relatively simple such as a straight stitch. However, there is a possibility that stitches whose contour is deformed may be formed on the workpiece cloth when the stitch pattern such as picture and character patterns is complicated or when the stitch pattern requires a complicated rocking manner of a sewing needle or complicated movement directions of the workpiece cloth in the normal sewing such as a triple stitch or multiple stitch zigzag.

In view of the above-described possibility, it is desired to select a stitch pattern suitable for the free motion sewing, e.g. straight stitch, when the free motion sewing is performed. The inventors then devised an arrangement for prohibiting the sewing operation when a stitch pattern unsuitable for the free motion sewing is selected when the feed dog is in the drop feed state.

On the other hand, some types of the conventional sewing machines are designed so that an embroidering unit is detachably attached to the machine main body. The embroidering unit comprises an embroidery frame for holding a workpiece cloth and an embroidery frame moving mechanism for moving the embroidery frame. Japanese patent publication No. 4-371189 (A) discloses one of such types of sewing machines. The workpiece cloth is moved by the embroidery frame moving mechanism when the embroidering unit is attached to the machine main body. Accordingly, the feed dog is turned into the drop feed state. However, in the case where the embroidering unit is attached to the conventional sewing machine, a complicated stitch pattern unsuitable for the free motion sewing can be formed on the workpiece cloth even when the feed dog is in the drop feed state. Consequently, prohibition of the sewing operation to form a complicated stitch pattern only on condition that the feed dog is in the drop feed state results in inconvenience.

SUMMARY OF THE INVENTION

Therefore, an object of the present invention is to provide a sewing machine in which the feed dog is switchable between the normal state and the drop feed state and which can form desirable stitches even when the sewing operation is performed in any manner or mode.

The present invention provides a sewing machine comprising a machine main body including a bed, sewing means for executing a sewing operation, and a feed dog provided in the bed of the main body to be displaced between positions above and below a top face of the bed in a normal state thereby feeding the workpiece cloth. Stitch selecting means is provided for selecting at least one of a number of stitch patterns. Control means is provided for controlling the sewing means so that the sewing means executes the sewing operation on a workpiece cloth based on the stitch pattern selected by the stitch selecting means. Switching means is provided for switching the feed dog between the normal state and a drop feed state in which the feed dog remains at the position below the top face of the bed. Feed dog position judging means is provided for judging whether the feed dog is in the drop feed state. Stitch pattern judging means in provided for judging whether the stitch pattern selected by the stitch selecting means is suitable for formation on stitches in the drop feed state of the feed dog, when the feed dog is in the drop feed state. Informing means is provided for informing results of judgment by the stitch pattern judging means.

According to the above-described sewing machine, the user can recognize whether the selected stitch pattern is suitable for the formation of stitches in the drop feed state of the feed dog, based on the contents informed by the informing means. When the selected stitch pattern is unsuitable for the formation of stitches in the drop feed state, the user needs to determine which way he or she should take, to continue the sewing operation with the selected stitch pattern or to re-select another stitch pattern. For this purpose, the informing means preferably informs unsuitability of the stitch pattern only when the stitch pattern judging means judges that the stitch pattern selected by the stitch selecting means is unsuitable for the formation of the stitches in the drop feed state of the feed dog.

The control means preferably controls the sewing means so that the sewing operation by the sewing means is prohibited when the stitch pattern judging means judges that the stitch pattern selected by the stitch selecting means is unsuitable for the formation of the stitches in the drop feed state of the feed dog. Consequently, the sewing operation can be executed only in a case where stitches can be formed on the workpiece cloth without deformation even when the feed dog is in the drop feed state.

The stitch patterns preferably include a number of character patterns. The sewing machine preferably further comprises a display device provided on the machine main body for displaying the stitch pattern selected by the stitch selecting means. Furthermore, the informing means preferably comprises the display device. In this arrangement, since information informed by the informing means is displayed on the display device, the user can easily-understand the contents of the informed information. Moreover, since the display device for displaying the selected stitch pattern is also used for the informing purpose, another display device dedicated for informing the results of judgment by the stitch pattern judging means is not required and accordingly, the manufacturing cost of the sewing machine is reduced.

The informing means preferably displays either one or both of a message urging selection of a suitable stitch pattern and at least one suitable stitch pattern in a case where the stitch pattern judging means judges that the stitch pattern selected by the stitch selecting means is unsuitable for the formation of the stitches in the drop feed state of the feed dog. Consequently, the user can reselect a suitable stitch pattern in response to the displayed contents.

The sewing machine preferably further comprises a presser foot for pressing an upper side of the workpiece cloth, a cloth thickness sensor for delivering cloth thickness data according to a height of the presser foot from the bed, and thread feed control means for controlling an amount of thread fed from a thread source based on the cloth thickness data delivered from the cloth thickness sensor. In this arrangement, the feed dog position judging means judges whether the feed dog is in the drop feed state, based on the cloth thickness data delivered from the cloth thickness sensor. Whether the feed dog is in the drop feed state can be judged by using the cloth thickness sensor constituting the thread feed control means. Consequently, the arrangement of the sewing machine can be prevented from being complicated and the manufacturing cost thereof can be reduced.

Furthermore, the feed dog position judging means preferably judges that the feed dog is out of the drop feed state or in the normal state, when the cloth thickness data delivered from the cloth thickness sensor within a predetermined period in an initial stage of the sewing operation is increased relative to the cloth thickness data delivered from the cloth thickness sensor when the workpiece cloth has been set on the bed.

The sewing machine may further comprise an embroidering unit unit detachably attached to the machine main body and including an embroidery frame for holding the workpiece cloth and an embroidery frame moving mechanism for moving the embroidery frame holding the workpiece cloth. In this case, the switching means switches the feed dog to the drop feed state when the embroidering unit is attached to the machine main body. However, in a case where an embroidering operation is executed with the embroidering unit being attached to main body, stitches can be formed on the workpiece cloth without deformation of the contour even when the selected stitch pattern is unsuitable for the formation of stitches in the drop feed state of the feed dog. Accordingly, in a case where the embroidering unit is attached to the main body, the control means controls the sewing means so that the sewing operation by the sewing means is allowed even when the stitch pattern judging means judges that the stitch pattern selected by the stitch selecting means is unsuitable for the formation of the stitches in the drop feed state of the feed dog.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figure 2:
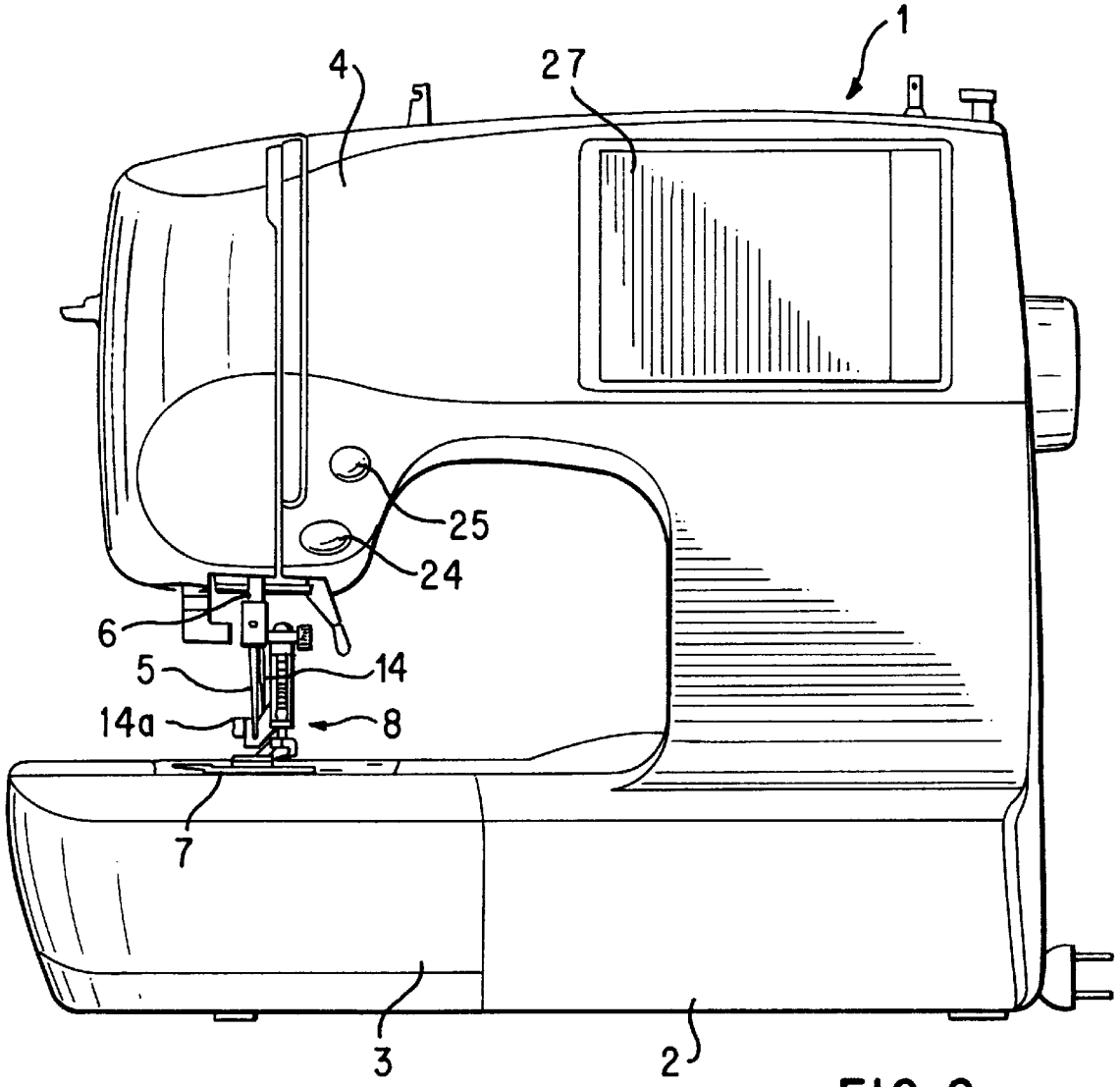
FIG. 2 is a front view of the sewing machine.

One embodiment of the present invention will be described with reference to the drawings. Referring first to FIG. 2, an electronic control type household sewing machine to which the invention is applied is shown. A main body 1 of the sewing machine comprises a bed 2 and an arm 3 formed integrally with the bed 2. A flat sewing table 4 (see FIG. 4) is detachably attached to a left-hand front end of the bed 2. A distal end of the arm 3 is provided with a needle bar 6 having a sewing needle 5, and a presser foot 8 for pressing a workpiece cloth (not shown) against an upper surface of a throat plate 7.

Figure 6:
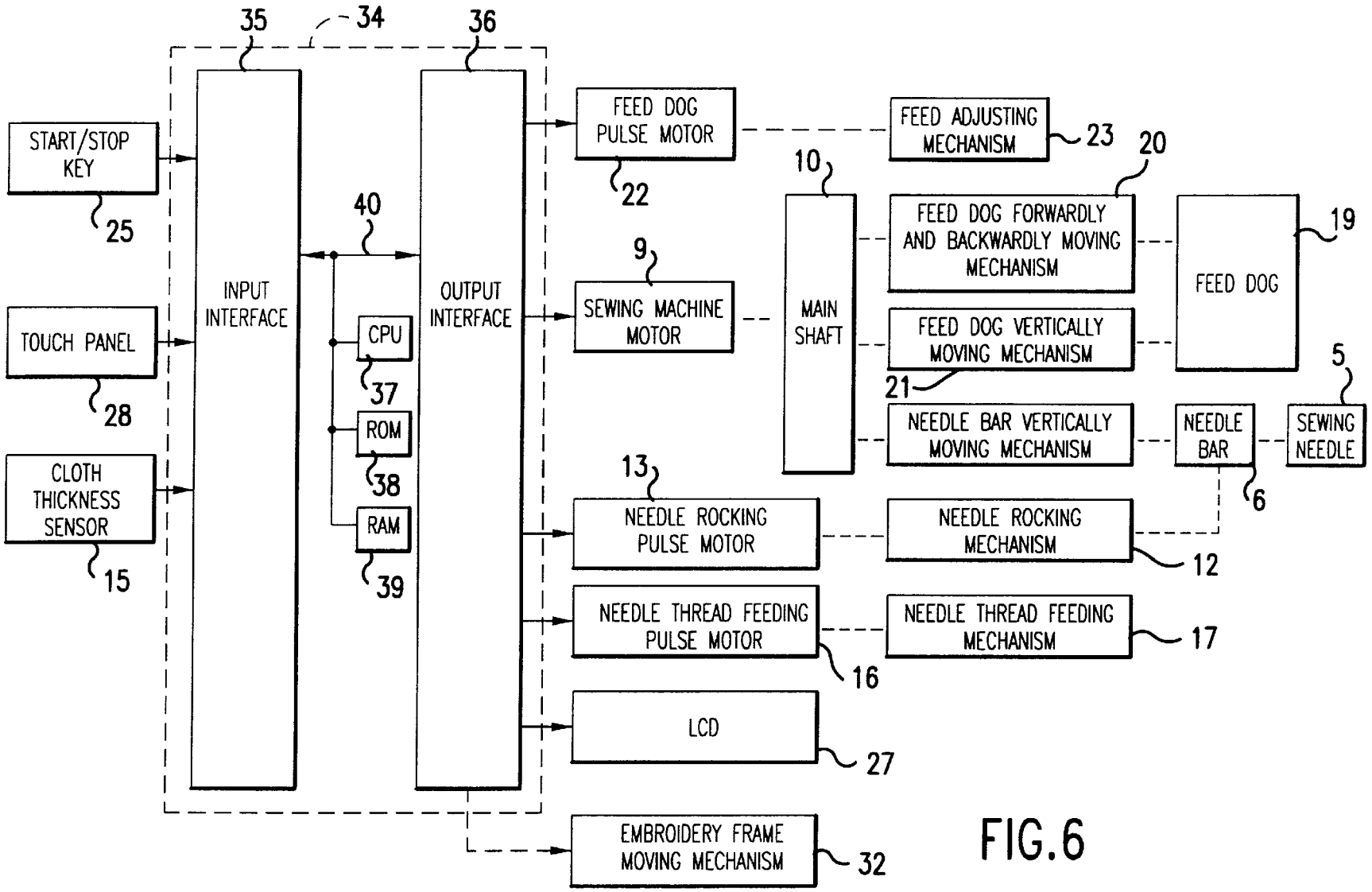
FIG. 6 is a schematic block diagram showing an electrical arrangement of the sewing machine.

A sewing machine motor 9 and a main shaft 10 driven by the motor 9 are provided in the machine main body 1, as shown in FIG. 6. Rotation of the main shaft 10 is transferred through a needle bar lifting mechanism 11 to the needle bar 6 so that the needle bar 6 and accordingly the needle 5 are vertically driven in synchronism with the rotation of the main shaft 10. The arm 3 accommodates therein a needle rocking mechanism 12 for rocking the needle 6 rightward and leftward and a needle rocking pulse motor 13 serving as a drive source for the needle rocking mechanism 12, whereby the sewing machine can perform a zigzag sewing and other sewing manners.

Figure 3:
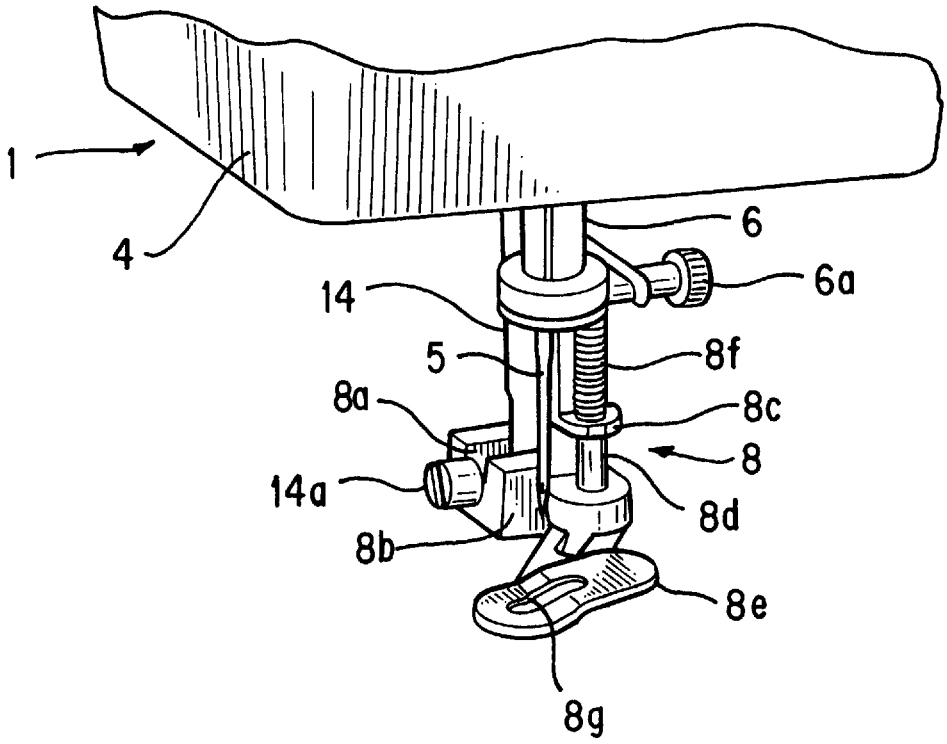
FIG. 3 is an enlarged perspective view of a presser foot and other parts of the sewing machine.

A presser bar 14 is provided on a distal end of the arm 3 as shown in FIG. 3. The presser foot 8 is detachably mounted on a lower end of the presser bar 14 by a screw 14*a* screwed through a groove 8*a*. The presser bar 14 is moved, when an operation lever (not shown) is operated, between a lower position at which the presser foot 8 acts on the workpiece cloth and an upper position at which the presser foot 8 is withdrawn upward. The presser foot 8 attached to the main body 1 shown in FIG. 3 is for a free motion sewing and is used when the free motion sewing is performed particularly on a quilt.

The presser foot 8 for the free motion sewing includes a holder 8*b* having a groove 8*a*, and a shaft 8*d* inserted through two holes 8*c* formed in the holder 8*b* to be vertically spaced away from each other. Only the lower hole 8*c* is shown. The presser foot 8 further includes a pressing face 8*e* provided on a lower end of the shaft 8*d*. Accordingly, the shaft 8*d* with the pressing face 8*e* is vertically moved independently of the presser bar 14. A compression coil spring 8*f* is provided about the shaft 8*d* between the holes 8*c* for downwardly urging the pressing face 8*e*. As a result, the pressing face 8*e* downwardly urged by the compression coil spring 8*f* presses the workpiece cloth when the presser bar 14 occupies the lower position. Since a pressing force the pressing face 8*e* applies to the workpiece cloth is relatively small, the workpiece cloth can be moved. The pressing face 8*e* is formed with an oblong hole 8*g* through which the sewing needle 5 passes. The hole 8*g* is provided so as to allow a horizontal movement or rocking of the needle 5.

A shuttle mechanism (not shown) and a feed dog 19 (see FIG. 5) are provided below the throat plate 7. The feed dog 19 feeds the workpiece cloth during ascent of the needle 5. The rotation of the main shaft 10 is transferred through a feed dog forwardly and backwardly moving mechanism 20 and a feed dog vertically moving mechanism 21 to the feed dog 19. The feed dog 19 is thus moved forward and backward and vertically in synchronism with the rotation of the main shaft 10. An amount of forward and backward movement of the feed dog 19 and accordingly, an amount of feed of the workpiece cloth are controlled via a feed adjusting mechanism 23 by a feed dog pulse motor 22.

The main body 1 of the sewing machine is provided with a needle thread feeding mechanism 17 operated by a needle thread feeding pulse motor 16. Both of the feeding mechanism 17 and the pulse motor 16 are shown only in FIG. 6 and a detailed description of them are eliminated. An amount of needle thread to be fed is adjusted by the feeding mechanism 17 so as to be a suitable value according to a thickness and amount of feed of the workpiece cloth, and an amount of rocking movement of the needle.

Figure 7:
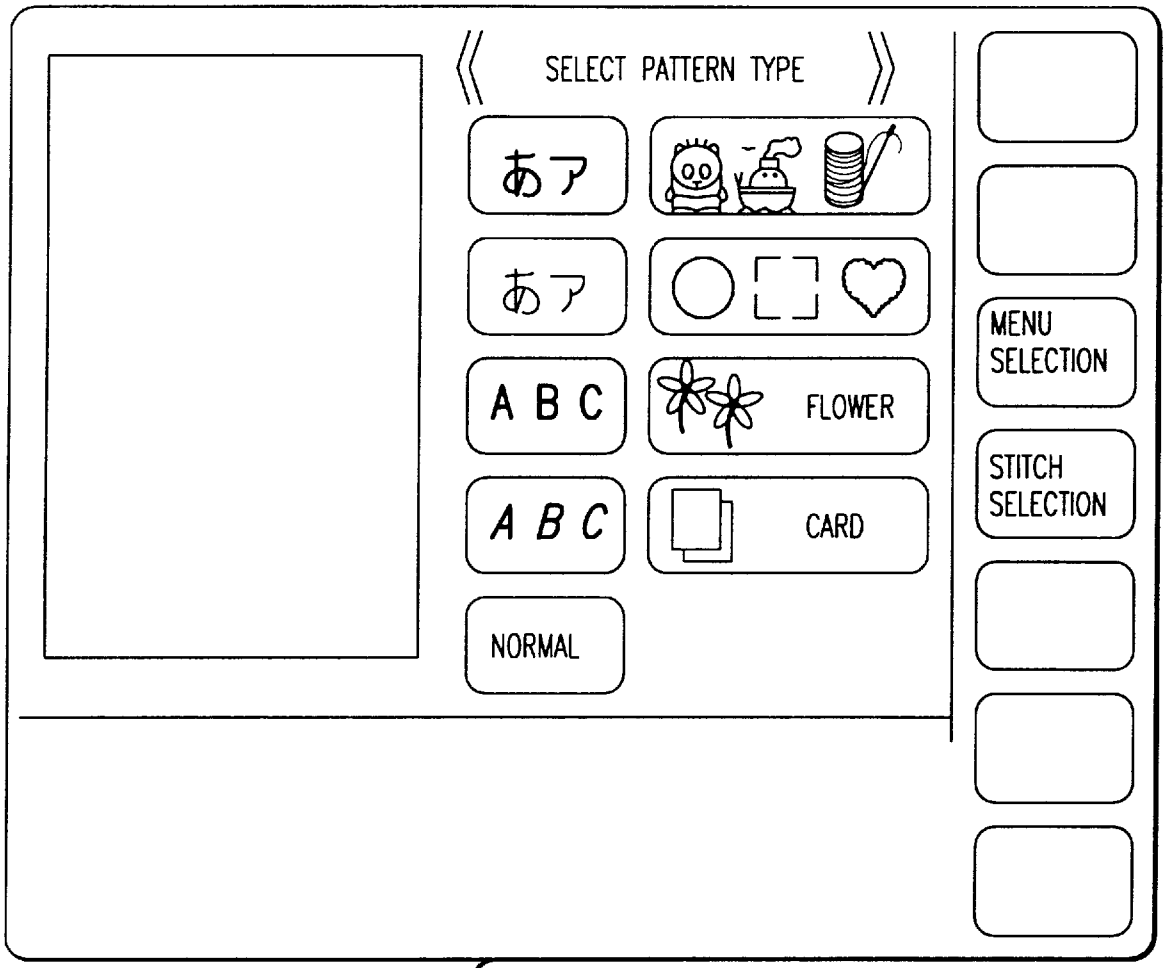
FIG. 7 illustrates an example of initial screen of an LCD incorporated in the sewing machine.

A power supply switch 24 and a start/stop key 25 are provided on a left-hand end front of the arm 4. Furthermore, a liquid crystal display (LCD) 27 is provided on the central front of the arm 4. The LCD 27 serves as a display device for displaying various patterns, messages, etc. More specifically, the LCD 27 displays a menu screen (see FIG. 6), a stitch pattern selection screen (see FIGS. 7 and 8), etc. when a sewing operation is to be executed by the sewing machine, as will be described in detail later.

A touch panel 28 (shown only in FIG. 6) constituting various operation keys is provided on the surface of the LCD 27. The touch panel 28 comprises a number of transparent electrodes arranged vertically and horizontally and detects where the user touches it, as well known in the art. The user touches the touch panel 28 so that a desired stitch pattern is selected and an amount of rocking movement of the needle, a length of stitch, a thread tension, etc. are adjusted. In the stitch pattern selection screens shown in FIGS. 7 and 8, the name and contour of the selected stitch pattern are displayed on a selected contents display region A provided on an upper screen portion of the LCD 27.

Figure 4:
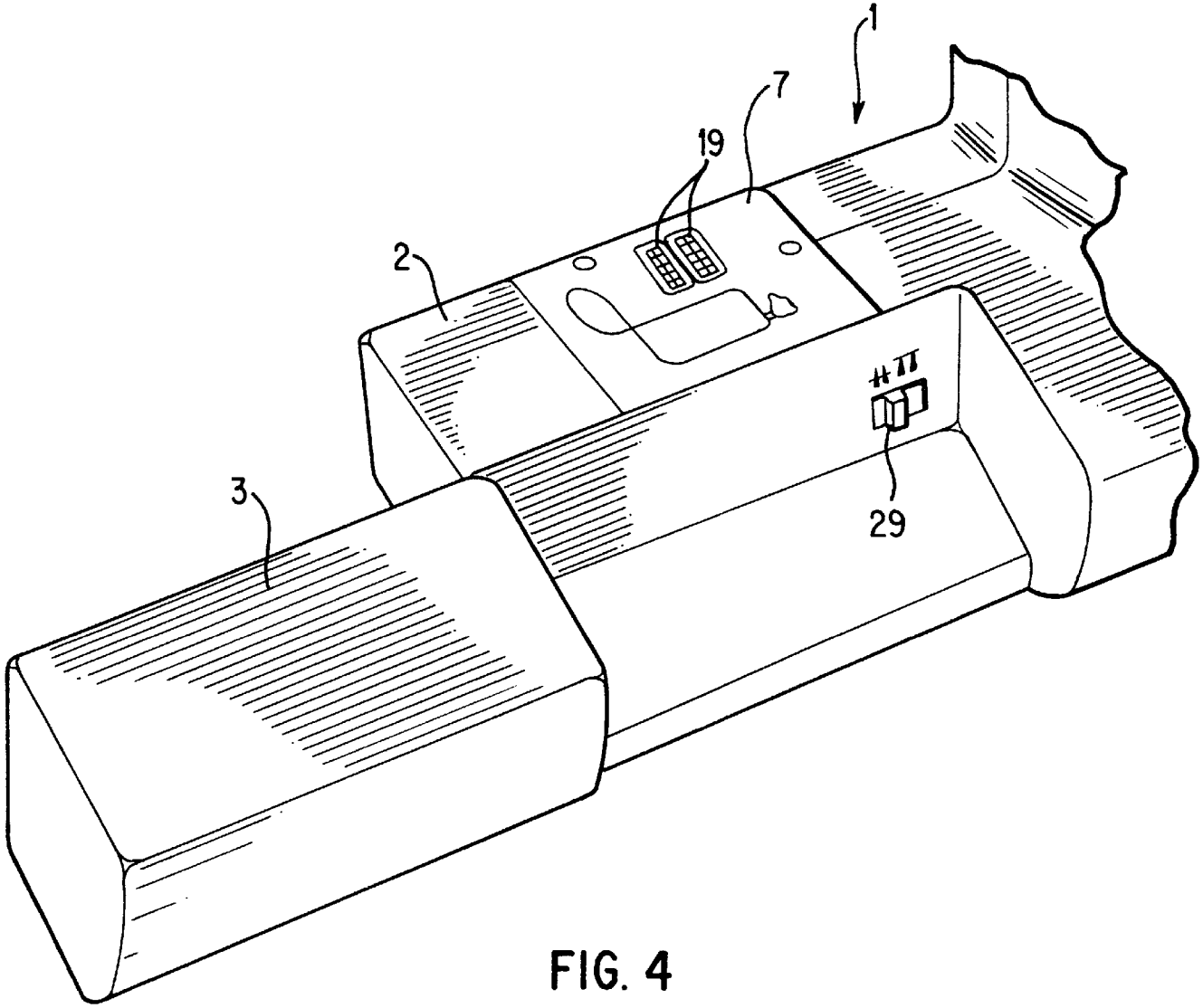
FIG. 4 is an enlarged perspective view of a bed with a sewing table being detached.

A feed dog lifting lever 29 serving as switching means is provided at a side portion of the bed 2 which is exposed when the table 3 is detached therefrom, as shown in FIG. 4. When the feed dog lifting lever 29 is switched to a left-hand position as shown in FIG. 4, the feed dog 19 is turned to a normal state in which the feed dog is displaced between two positions below and above a top face of the bed 2 or throat plate 7 to feed the workpiece cloth. When the feed dog lifting lever 29 is switched to a right-hand position, the feed dog is turned to a drop feed state in which the feed dog remains at the position below the top face of the bed not to feed the workpiece cloth. Accordingly, the feed dog lifting lever 29 is switched to the right-hand position to turn the feed dog into the drop feed state when a free motion sewing in which the sewing is performed with the workpiece cloth being moved by the user is executed.

Figure 5:
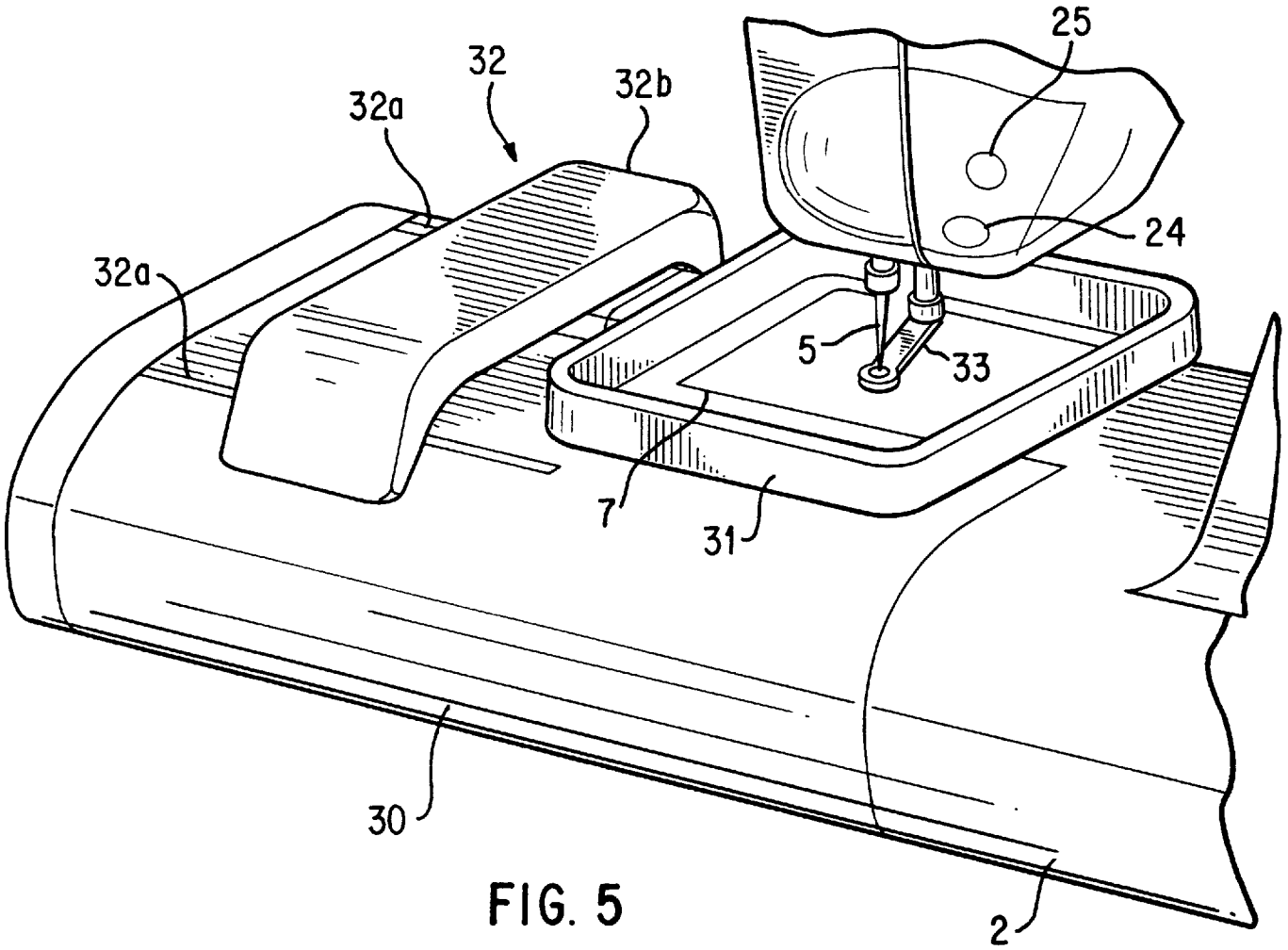
FIG. 5 is an enlarged perspective view of the bed with an embroidering unit being attached.

In the sewing machine of the embodiment, an embroidering unit 30 is detachably attached to the bed 2 instead of the table 3, as shown in FIG. 5. The embroidering unit 30 includes an embroidery frame 31 for holding the workpiece cloth and an embroidery frame moving mechanism 32 for horizontally moving the embroidery frame 31 holding the workpiece cloth. The embroidery frame moving mechanism 32 includes a movable member 32*b* moved leftward and rightward along a linear guide 32*a* provided on an upper surface of the embroidery unit 30. The embroidery frame 31 is mounted on the movable member 32*b* to be movable forward and backward. When the embroidering unit 30 is attached to the bed 2, a connector (not shown) provided in the bed 2 is connected to another connector (not shown) of the embroidering unit 30 so that the embroidery unit 30 is electrically connected to the main body 1 of the sewing machine.

With attachment of the embroidering unit 30 to the bed 2, the feed dog lifting lever 29 is designed to be switched to the right-hand position. Accordingly, when an embroidery is sewn with the workpiece cloth being held by the embroidery frame 31 and moved therewith, the feed dog 19 is turned into the drop feed state so that the movement of the workpiece cloth is not obstructed by the feed dog 19.

An embroidering presser foot 43 is attached to the presser bar 14 when the embroidering operation is executed. Differing from the free motion sewing presser foot 8, the embroidering presser foot 43 is vertically moved in response to the vertical movement of the presser bar 14, and presses the workpiece cloth with a suitable force from above when the presser bar 14 occupies a lower position.

Referring to FIG. 6, an electrical arrangement of the sewing machine is schematically shown. A control device 34 is mainly composed of a microcomputer comprising an input interface 35, output interface 36, CPU 37, ROM 38 and RAM 39 all of which are connected by a bus line 40.

The ROM 38 stores control programs for controlling the sewing operation of the sewing machine and the displaying operation of the LCD 27, and programs for data processing such as readout, edit, etc. of embroidery data. The ROM 38 further stores normal sewing data for representing operation patterns of the needle bar 6 and feed dog 19 with respect to various types of normal sewing manners (straight stitch, zigzag stitch, overcast stitch, etc.) in which the stitch patterns differs from one another. The ROM 38 further stores embroidery data for defining stitch patterns of a number of embroidery patterns and display data (bit map data) necessary for the displaying operation of the LCD 27. The embroidery data stored in the ROM 38 indicates amounts of movement (needle locations) of the workpiece cloth or embroidery frame per stitch, etc.

To the output interface 36 are connected the sewing machine motor 9, needle rocking pulse motor 13, feed dog pulse motor 22, needle thread feeding pulse motor 16, and LCD 27. Furthermore, the embroidery frame moving mechanism 32 is connected to the output interface 31 when the embroidering unit 30 is attached to the bed 2. The touch panel 28, start/stop key 25, and cloth thickness sensor 15 are connected to the input interface 30.

The cloth thickness sensor 15 is disposed on the presser bar 14 to detect the thickness of the workpiece cloth on the basis of a height of the presser foot 8. The cloth thickness sensor 15 comprises a well known linear type potentiometer including a movable member rotated in normal and reverse directions according to the height of the shaft 8*d* of the presser foot 8 and a variable resistor generating a voltage (cloth thickness data) according to a rotational position of the movable member.

The control device 34 calculates a proper needle thread feed per stitch, based on the cloth thickness data delivered from the cloth thickness sensor 15, a feed of the workpiece cloth and a rocking of needle. The control device 34 controls the needle thread feeding pulse motor 16 on the basis of the results of calculation. Thus, the needle thread feeding mechanism 17, needle thread feeding pulse motor 16 and control device 34 constitute thread feed control means.

Upon setting of the embroidering unit 30, the connector of the embroidering unit 30 is connected to that at the main body 1 side, whereby the control device 34 detects attachment of the embroidering unit 30. Based on the selecting operations by the user on the touch panel 28, the control device 34 controls the various mechanisms of the sewing machine according to the programs stored in the ROM 38 and the various data so that sewing operations for the various normal sewing manners and embroidering operation are executed. In the execution of the sewing operation, the control device 34 controls the LCD 27 so that the menu screen (see FIG. 7), stitch pattern selection screen (see FIGS. 8 and 9), or embroidery pattern selection screen (not shown) is displayed on the LCD 27. Viewing the screen of the LCD 27, the user touches the touch panel 28 to select a desired normal sewing manner or embroidery pattern. Accordingly, the touch panel 28 constitutes stitch selecting means in the invention.

When the user instructs the start of the sewing operation, the control device 34 judges, by its software arrangement, whether the feed dog 19 is in the drop feed state, based on the detection signal delivered from the cloth thickness sensor 15, as will be described in detail later. Accordingly, the control device 34 constitutes feed dog position judging means. In this regard, the control device 34 judges whether cloth thickness data t is increased within a predetermined period in an initial stage of the sewing operation, for example, during a period of one or more revolutions of the main shaft 10, relative to the cloth thickness data t delivered from the cloth thickness sensor at the time of start of the sewing operation, thereby judging whether the feed dog 19 is in the drop feed state. More specifically, the control device 34 judges whether the feed dog 19 has been displaced above the bed 2 to thereby lift the presser foot 8 upward, thereby judging whether the feed dog 19 is in the drop feed state.

The control device 34 further judges whether the selected stitch pattern is suitable for formation of stitches in the drop feed state of the feed dog 19 or for the free motion sewing, when the feed dog 19 is in the drop feed state and embroidering unit 30 is not attached to the bed 2 or the machine is not in the embroidering mode. Thus, the control device 34 constitutes stitch pattern judging means.

Figure 8:
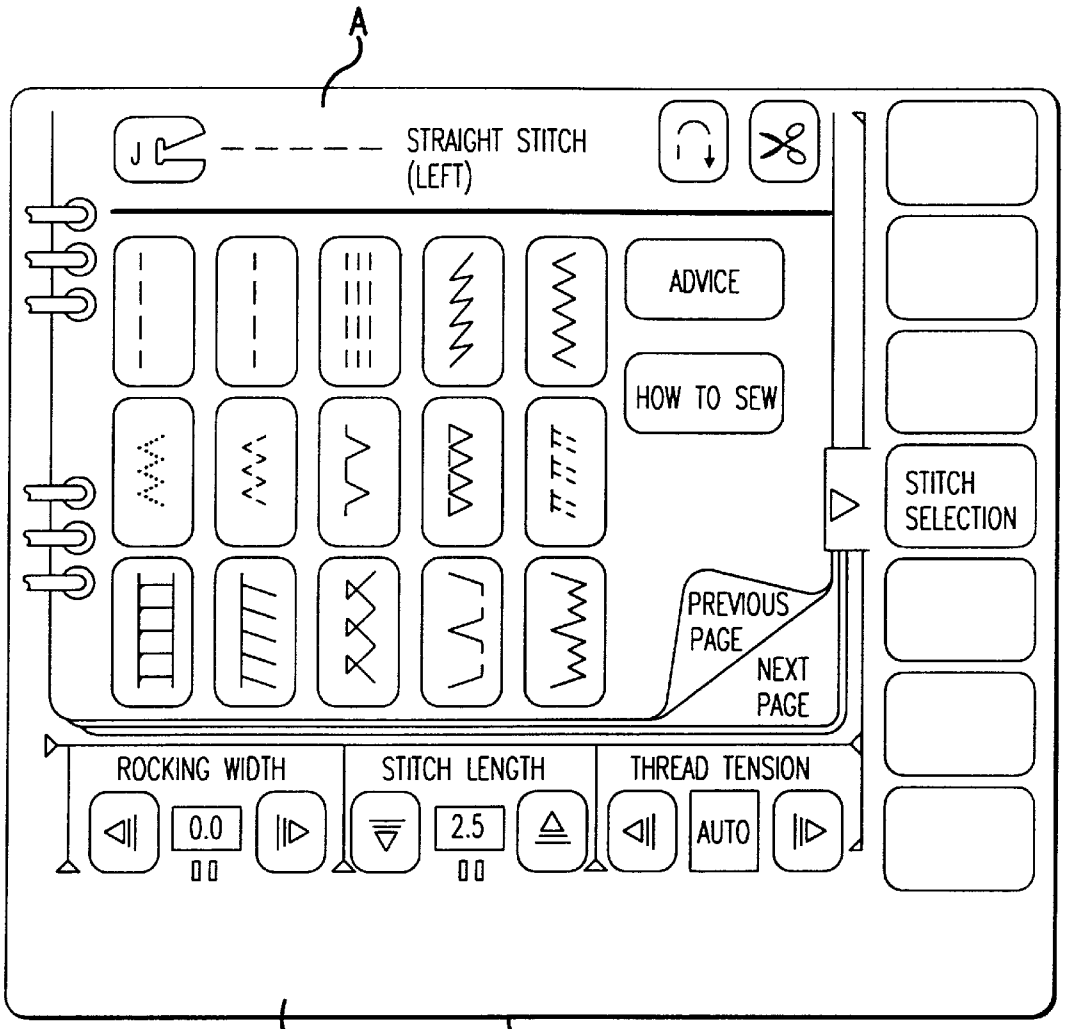
FIG. 8 illustrates an example of a stitch pattern selection screen of the LCD for the normal sewing.

In the embodiment, when the selected stitch pattern is unsuitable for the free motion sewing, the control device 34 controls the LCD 27 so that the LCD 27 displays, in a message display region B thereof, information urging the user to re-select a suitable stitch pattern and suitable stitch patterns (see FIG. 8). The control device 34 further prohibits the sewing operation. In this regard, the stitch pattern suitable for the free motion sewing includes the straight stitch and the zigzag stitch in those of the normal sewing mode (see FIG. 6). The control device 34 thus constitutes informing means.

Figure 1:
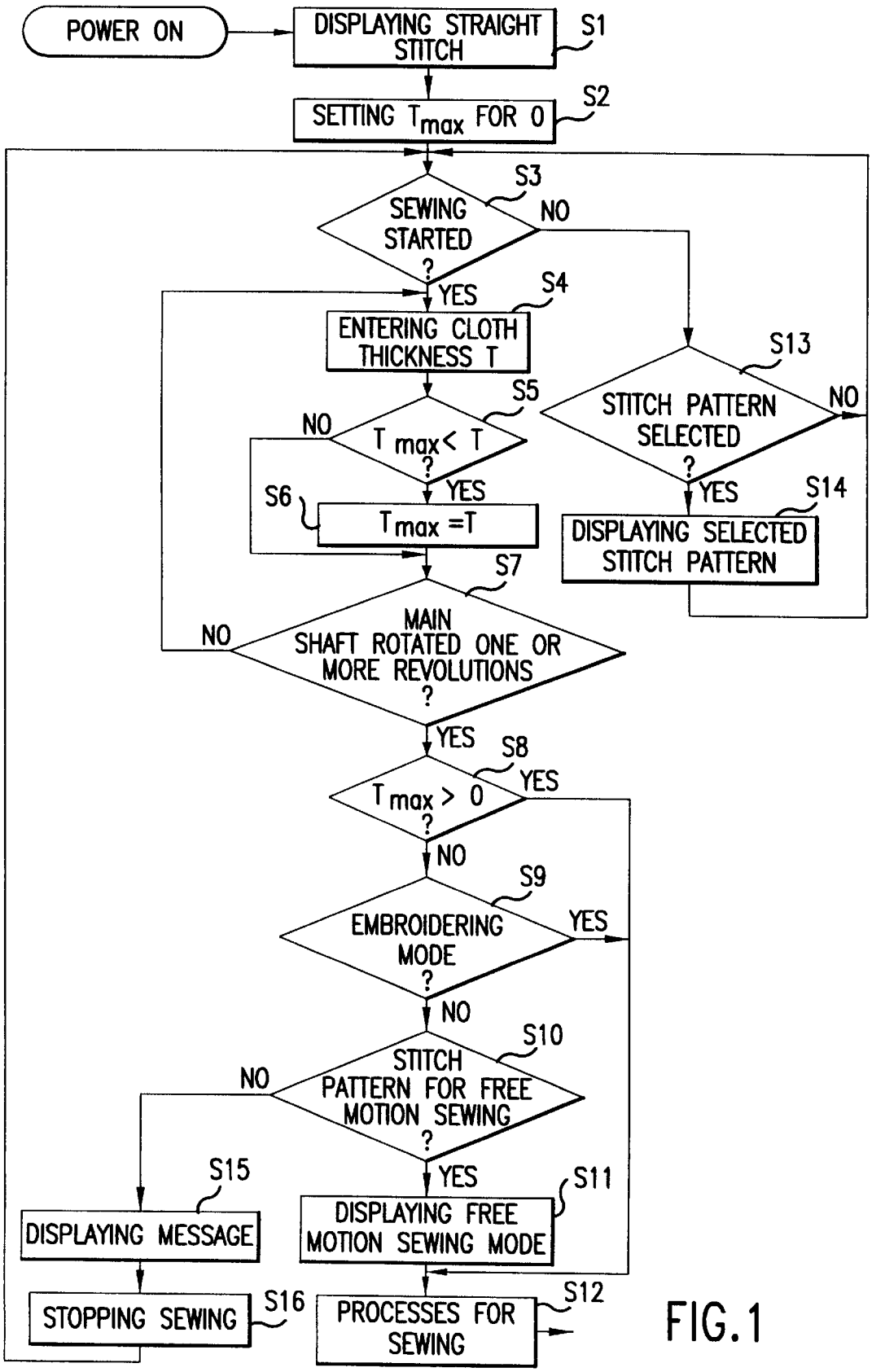
FIG. 1 is a flowchart showing the procedure of processes from selection of a stitch pattern to the sewing by the sewing machine of one embodiment in accordance with the present invention.

The operation of the sewing machine will now be described with reference to FIG. 1. FIG. 1 shows the procedure of processes from selection of a stitch pattern to the sewing by the sewing machine. The operation of the sewing machine in the case of the free motion sewing will first be described. The user operates the feed dog lifting lever 29 so that the feed dog 19 is switched to the drop feed state. The presser foot 8 for the free motion sewing is attached to the presser bar 14. The LCD 27 displays the menu screen as the initial screen when the power switch 24 is then turned on. The control device 34 successively carries out the processes shown in the flowchart of FIG. 1.

A number of stitch patterns are roughly divided, on the menu screen, into nine types including a character pattern, picture pattern, normal sewing, etc. The user touches the touch panel 28 to select a desired type. The normal sewing type is selected when the free motion sewing is to be executed. As a result, the LCD 27 displays the stitch pattern selection screen (see FIG. 8) for the normal sewing is displayed on the LCD 27 at step S1. A number of stitch patterns for the normal sewing are displayed on the stitch pattern selection screen. The straight stitch is selected in the initial state. That is, an indication of "STRAIGHT STITCH" and a pattern thereof are displayed in the selected content display region A of the stitch pattern selection screen of the LCD 27. In the case of the straight stitch, the user can touch the touch panel 28 to specify the length of stitches.

The workpiece cloth is then set on the top face of the bed 2. When the presser bar 14 is lowered, the control device 34 detects the thickness T of the workpiece cloth, based on the cloth thickness data t delivered from the cloth thickness sensor 15. Since the feed dog 19 is then located at a lowermost position, an actual thickness of the workpiece cloth is detected. As a result, the control device 34 calculates a feed of needle thread per stitch according to the thickness To of the workpiece cloth, the length of the stitches (feed of workpiece cloth), rocking movement of needle, etc. The thread supply pulse motor 25 is driven according to the results of calculation so that the feed of needle thread per stitch is adjusted by the needle thread feeding mechanism 17. Furthermore, the control device 34 sets zero for a variable $T_{max}$ used to judge whether the feed dog 19 is in the drop feed state at step S2. Data of the variable $T_{max}$ is stored in the RAM 39.

The start/stop key 25 is operated when the straight stitch is to be executed. The control device 34 drives the sewing machine motor 9 so that the main shaft 10 is rotated. The sewing operation then starts (YES at step S3). In this regard, the control device 34 starts the sewing operation on condition that the presser bar 14 has been lowered.

The control device 34 then enters a value obtained by subtracting the thickness To of the workpiece cloth from the thickness data t delivered from the cloth thickness sensor 15, as the cloth thickness T at step S4. Accordingly, the cloth thickness T is zero at the time of start of the sewing operation. The control device 34 compares the cloth thickness T with the variable $T_{max}$ stored in the RAM 39 at step S5. Since the feed dog 19 is in the drop feed state, the position of the shaft 8*d* of the presser foot 8 is not varied. Consequently, the cloth thickness T remains zero. Since the cloth thickness T does not exceed the variable $T_{max}$ (NO at step S5), the control device 34 judges at step S7 whether the main shaft 10 is rotated one or more revolutions. When the main shaft 10 has been rotated one or more revolutions (YES at step S7), the control device 34 judges at step S8 whether the variable $T_{max}$ is zero. Since the variable $T_{max}$ remains zero (NO at step S8), the control device 34 judges at step S9 whether the sewing mode is an embroidering mode. Since the sewing mode is not the embroidering mode in this case (NO at step S9), the control device judges at step S10 whether the selected stitch pattern is suitable for the free motion sewing.

The selected stitch pattern is the straight stitch, which is suitable for the free motion sewing as described above (YES at step S10). Then, the control device 34 controls the LCD 27 so that an indication (not shown) of the free sewing mode is displayed thereon at step S11 and executes processes for the sewing operation at step S12. Consequently, stitches are formed on the workpiece cloth in the free motion sewing.

Figure 9:
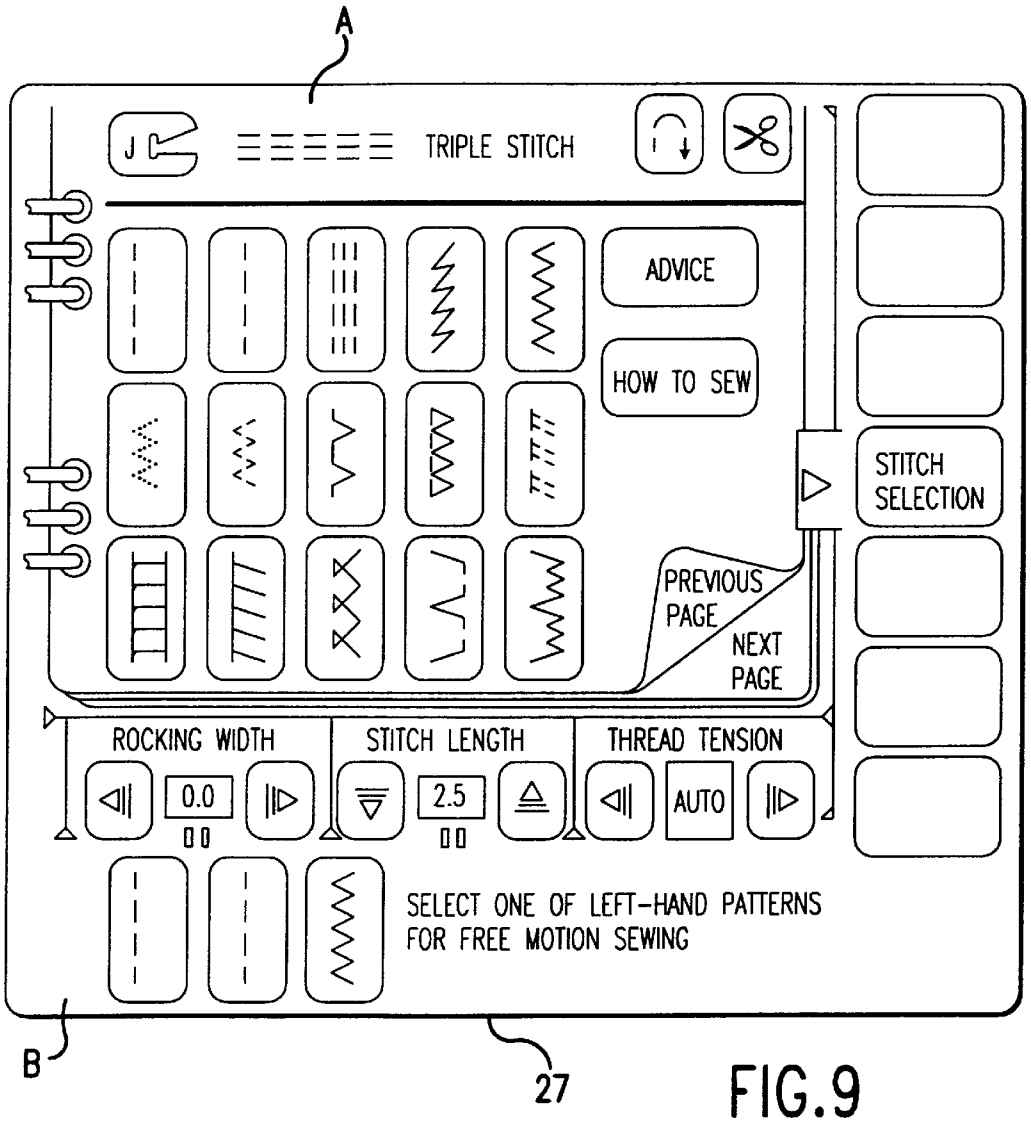
FIG. 9 illustrates another example of the stitch pattern selection screen for the normal sewing.

On the other hand, when wishing to form a triple stitch on the workpiece cloth, the user touches the touch panel 15 on the stitch pattern selection screen to select a pattern for the triple stitch (NO at step S3; and YES at step S13). An indication of "TRIPLE STITCH" and the pattern thereof are displayed in the selected pattern display region A on the screen as shown in FIG. 9 at step S14.

Subsequently, when the start/stop key 13 is operated to start the sewing operation (YES at step S3), the control device 34 calculates the cloth thickness T, based on the cloth thickness data t delivered from the cloth thickness sensor 15 during one revolution of the main shaft 10, and compares the cloth thickness T with the variable $T_{max}$ at steps S4 to S8. In this case, too, the variable $T_{max}$ is zero (NO at step S8) and the sewing mode is not the embroidering mode (NO at step S9). Consequently, the control device 34 judges at step S10 whether the selected stitch pattern is suitable for the free motion sewing. Since the triple stitch is unsuitable for the free motion sewing (NO at step S10), the LCD 27 displays, in a message display region B, patterns suitable for the free motion sewing and a message, "Select one of left-hand patterns for the free motion sewing" at step S15. Then, the sewing operation is stopped at step S16.

The table 3 is detached from the bed 2 and the embroidering unit 30 is attached thereto, instead when the embroidering is to be executed. Furthermore, the presser foot 8 for the free motion sewing is replaced by the presser foot 33 for the embroidering. The feed dog lifting lever 29 is located at the right-hand position in this case so that the feed dog 19 is switched to the drop feed state. The user operates the touch panel 17 on the menu screen to select a pattern type for the embroidering (one of pattern types other than those for the normal sewing).

Upon start of the sewing operation at step S3, the control device 34 calculates the cloth thickness T, based on the cloth thickness data t delivered from the cloth thickness sensor 15 during one revolution of the main shaft 10, and compares the cloth thickness T with the variable $T_{max}$ at steps S4 to S8. Since the variable $T_{max}$ is zero in this case (YES at step S8), the control device 34 at step S9 whether the sewing mode is an embroidering mode. The embroidering unit 30 is attached to the main body 1 such that the sewing mode is the embroidering mode (YES at step S9). Consequently, the control device 34 executes processes for the sewing or embroidering operation without judging whether the selected stitch pattern is suitable for the free motion sewing, at step S12.

Although a detailed description is eliminated, the presser foot 8 is raised by the feed dog 19 projecting above the bed 2 during one revolution of the main shaft 10 when the feed dog 19 is not in the drop feed state, whereupon the cloth thickness T exceeds zero. Accordingly, the cloth thickness T is substituted for the variable $T_{max}$ and accordingly, the variable $T_{max}$ exceeds zero (YES at step S5; and steps S6 to S8). In this case, the sewing operation is continued even when one of the stitch patterns for the normal sewing has been selected.

According to the above-described embodiment, when the user selects the stitch pattern and the start of the sewing operation is instructed, the control device 34 judges whether the feed dog 19 is in the drop feed state, during one revolution of the main shaft 10 from the start of the sewing operation. Then, when the feed dog 19 is not in the drop feed state and the sewing mode is not the embroidering mode, the control device 34 judges whether the selected stitch pattern is suitable for the free motion sewing. Furthermore, when the selected stitch pattern is unsuitable for the free motion sewing, the control device 34 controls the LCD 27 so that the message display region B thereof displays the indication urging re-selection of a suitable stitch pattern or the message, "Select one of left-hand patterns for the free motion sewing" and the stitch patterns suitable for the free motion sewing.

Consequently, the user can reliably understand that the selected stitch pattern is unsuitable for the free motion sewing. Moreover, since the informed contents take the form of character information (message), the user can quickly understand the informed contents. Additionally, since the stitch patterns suitable for the free motion sewing are also displayed, the user can readily find a stitch pattern to be re-selected.

Furthermore, the sewing operation is stopped when the selected stitch pattern is unsuitable for the free motion sewing. Consequently, an unnecessary execution of the sewing operation can be prevented even when the user is unaware of the information about unsuitability of the stitch pattern for the free motion sewing.

The control device 34 judges whether the feed dog 19 is in the drop feed state, based on the cloth thickness data t delivered from the cloth thickness sensor 15. The thickness sensor is originally provided in the conventional sewing machines for controlling a feed of thread. Thus, since the cloth thickness sensor for controlling the thread feed is also used for the purpose of judging the drop feed state of the feed dog, no new device is required for detecting the drop feed state of the feed dog. Consequently, the construction of the sewing machine can be simplified.

The judgment as to whether the feed dog 19 is in the drop feed state is performed during the period of one revolution of the main shaft 10 elapsing from the start of the sewing operation. Thus, the drop feed state of the feed dog 19 can be detected at a relatively early stage of the sewing operation.

The sewing machine of the foregoing embodiment can be modified as follows. In the foregoing embodiment, the message display region B of the LCD 27 displays both of the message urging the user to re-select a stitch pattern suitable for the free motion sewing and the stitch patterns suitable for the free motion sewing. However, either one of them may be displayed in the region B. Furthermore, a buzzer or voice may be employed for the informing purpose in the case where the stitch pattern unsuitable for the free motion sewing has been selected.

In the foregoing embodiment, the sewing operation is prohibited when the selected stitch pattern is unsuitable for the free motion sewing. However, the sewing operation may or may not be prohibited. In the free motion sewing, the user freely moves the workpiece cloth to form a stitch thereon as if he or she drew a picture. Accumulating experience in the free motion sewing, the user can sometimes form even a relatively complicated stitch pattern in the free motion sewing. In such a case, the sewing operation need not be prohibited when a stitch pattern to be judged unsuitable for the free motion sewing has been selected.

Detecting means such as a limit switch may be provided for directly detecting the vertical movement of the presser bar, and the judgment as to whether the feed dog is in the drop feed state may be based on the results of detection by the detecting means. Furthermore, a sensor may be provided for detecting the switching of the feed dog 19 to the drop feed state by the feed dog lifting lever 29, and the judgment may be based on the results of detection by the sensor.

An "embroidering mode" key may be provided to be depressed when the embroidering operation is to be executed. Based on the depressing operation of the "embroidering mode" key by the user, the attachment of embroidering unit 30 may be judged.

The sewing machine is provided with a presser foot (not shown) for ordinary sewing manners as well as with the presser foot 8 for the free motion sewing and the embroidering presser foot 33. The presser foot for the ordinary sewing manners is vertically moved in response to the presser bar 14 as well known in the art. Consequently, when the presser foot for the ordinary sewing manners is attached to the presser bar 14, a force the presser foot for the ordinary sewing manners applies to the upper side of the workpiece cloth is large so that the workpiece cloth cannot freely be moved whether the feed dog 19 is in the drop feed state or not.

On the other hand, a force the free motion sewing presser foot 8 applies to the workpiece cloth is small so that the user can manually move the workpiece cloth even when the feed dog 19 is not in the drop feed state. In this case, means may be provided for detecting attachment of the free motion sewing presser foot 8 to the presser bar 14. When the detecting means has detected attachment of the free motion sewing presser foot 8 to the presser bar 14, the control device judges whether the selected stitch pattern is suitable for the free motion sewing. When the selected stitch pattern is unsuitable, that is informed of.

In the above-described arrangement, the cloth thickness sensor 15 is designed to detect the thickness of the workpiece cloth on the basis of the height of the presser bar 14, instead that of the shaft 8*e* of the presser foot 8. The control device 34 detects attachment of the free motion sewing presser foot 8, based on an output of the cloth thickness sensor 15. More specifically, the presser foot 8 is vertically moved independently of the presser bar 14. Accordingly, the height of the presser bar 14 is not varied when the feed dog 19 is either in the normal state or in the drop feed state. Consequently, the control device 34 can judge that the free motion sewing presser foot 8 has been attached, when the output of the cloth thickness sensor 15 is not varied during one revolution of the main shaft 10 or when the cloth thickness data t delivered from the cloth thickness sensor 15 remains at To detected at the start of the sewing operation and $T_{max}$ is zero (NO at step S8 in FIG. 1.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. A sewing machine comprising:

a machine main body including a bed;

stitch selecting means for selecting at least one of a number of stitch patterns;

sewing means for executing a sewing operation;

control means for controlling the sewing means so that the sewing means executes the sewing operation on a workpiece cloth based on the stitch pattern selected by the stitch selecting means;

a feed dog provided in the bed of the main body to be displaced between positions above and below a top face of the bed in a normal state, thereby feeding the workpiece cloth;

switching means for switching the feed dog between the normal state and a drop feed state in which the feed dog remains at the position below the top face of the bed;

feed dog position judging means for judging whether the feed dog is in the drop feed state;

stitch pattern judging means for judging, when the feed dog is in the drop feed state, whether the stitch pattern selected by the stitch selecting means is suitable for formation of stitches in the drop feed state of the feed dog; and informing means for informing results of judgment by the stitch pattern judging means.

2. A sewing machine according to claim 1, wherein the control means controls the sewing means so that the sewing operation by the sewing means is prohibited when the stitch pattern judging means judges that the stitch pattern selected by the stitch selecting means during the drop feed state of the feed dog is unsuitable for the formation of the stitches in the drop feed state of the feed dog.

3. A sewing machine according to claim 1, wherein the stitch patterns include a number of character patterns, which further comprises a display device provided on the machine main body for displaying the stitch pattern selected by the stitch selecting means, and wherein the informing means comprises the display device.

4. A sewing machine according to claim 2, wherein the stitch patterns include a number of character patterns, which further comprises a display device provided on the machine main body for displaying the stitch pattern selected by the stitch selecting means, and wherein the informing means comprises the display device.

5. A sewing machine according to claim 1, wherein the informing means informs unsuitability of the stitch pattern only when the stitch pattern judging means judges that the stitch pattern selected by the stitch selecting means is unsuitable for the formation of the stitches in the drop feed state of the feed dog.

6. A sewing machine according to claim 2, which further comprises an embroidering unit detachably attached to the machine main body and including an embroidery frame for holding the workpiece cloth and an embroidery frame moving mechanism for moving the embroidery frame holding the workpiece cloth, wherein the switching means switches the feed dog to the drop feed state when the embroidering unit is attached to the machine main body, and wherein in a case where the embroidering unit is attached to the machine main body, the control means controls the sewing means so that the sewing operation by the sewing means is allowed even when the stitch pattern judging means judges that the stitch pattern selected by the stitch selecting means is unsuitable for the formation of the stitches in the drop feed state of the feed dog.

7. A sewing machine according to claim 3, which further comprises an embroidering unit detachably attached to the machine main body and including an embroidery frame for holding the workpiece cloth and an embroidery frame moving mechanism for moving the embroidery frame holding the workpiece cloth, wherein the switching means switches the feed dog to the drop feed state when the embroidering unit is attached to the machine main body, and wherein in a case where the embroidering unit is attached to the machine main body, the control means controls the sewing means so that the sewing operation by the sewing means is allowed even when the stitch pattern judging means judges that the stitch pattern selected by the stitch selecting means is unsuitable for the formation of the stitches in the drop feed state of the feed dog.

8. A sewing machine according to claim 3, wherein the informing means displays either one or both of a message urging selection of a suitable stitch pattern and at least one suitable stitch pattern in a case where the stitch pattern judging means judges that the stitch pattern selected by the stitch selecting means is unsuitable for the formation of the stitches in the drop feed state of the feed dog.

9. A sewing machine according to claim 4, wherein the informing means displays either one or both of a message urging selection of a suitable stitch pattern and at least one suitable stitch pattern in a case where the stitch pattern judging means judges that the stitch pattern selected by the stitch selecting means is unsuitable for the formation of the stitches in the drop feed state of the feed dog.

10. A sewing machine according to claim 1, which further comprises a presser foot for pressing an upper side of the workpiece cloth, a cloth thickness sensor for delivering cloth thickness data according to a height of the presser foot from the bed, and thread feed control means for controlling an amount of thread fed from a thread source based on the cloth thickness data delivered from the cloth thickness sensor, and wherein the feed dog position judging means judges whether the feed dog is in the drop feed state, based on the cloth thickness data delivered from the cloth thickness sensor.

11. A sewing machine according to claim 2, which further comprises a presser foot for pressing an upper side of the workpiece cloth, a cloth thickness sensor for delivering cloth thickness data according to a height of the presser foot from the bed, and thread feed control means for controlling an amount of thread fed from a thread source based on the cloth thickness data delivered from the cloth thickness sensor, and wherein the feed dog position judging means judges whether the feed dog is in the drop feed state, based on the cloth thickness data delivered from the cloth thickness sensor.

12. A sewing machine according to claim 10, wherein the feed dog position judging means judges that the feed dog is not in the drop feed state, when the cloth thickness data delivered from the cloth thickness sensor within a predetermined period in an initial stage of the sewing operation is increased relative to the cloth thickness data delivered from the cloth thickness sensor when the workpiece cloth has been set on the bed.

13. A sewing machine according to claim 11, wherein the feed dog position judging means judges that the feed dog is not in the drop feed state, when the cloth thickness data delivered from the cloth thickness sensor within a predetermined period in an initial stage of the sewing operation is increased relative to the cloth thickness data delivered from the cloth thickness sensor when the workpiece cloth has been set on the bed.

14. A recording medium for storing a control program for operating a sewing machine, the control program accomplishing the functions of feed dog position judging means for judging whether a feed dog is in a drop feed state, based on cloth thickness data delivered from a cloth thickness sensor, and stitch pattern judging means for judging whether a stitch pattern selected by stitch pattern selecting means is suitable for formation of stitches in the drop feed state of the feed dog, when the feed dog is in the drop feed state.

* * * * *